US008293027B2

(12) United States Patent
Poyner et al.

(10) Patent No.: US 8,293,027 B2
(45) Date of Patent: Oct. 23, 2012

(54) PROTECTIVE ARRANGEMENT FOR A CONTROL DEVICE ASSOCIATED WITH A DISHWASHING APPLIANCE, AND ASSOCIATED APPARATUS AND METHOD

(75) Inventors: Dennis A. Poyner, Kinston, NC (US); David Sumner, Greenville, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 638 days.

(21) Appl. No.: 12/493,729

(22) Filed: Jun. 29, 2009

(65) Prior Publication Data

US 2009/0320892 A1 Dec. 31, 2009

Related U.S. Application Data

(63) Continuation-in-part of application No. 12/164,568, filed on Jun. 30, 2008.

(51) Int. Cl.
*B08B 3/00* (2006.01)

(52) U.S. Cl. ..... 134/56 D; 134/57 D; 134/58 D; 134/114

(58) Field of Classification Search ..... 134/56 D, 134/57 D, 58 D, 114
See application file for complete search history.

(56) References Cited

U.S. PATENT DOCUMENTS

| | | | | |
|---|---|---|---|---|
| 3,064,662 | A | 11/1962 | Given et al. | |
| 3,467,761 | A * | 9/1969 | Plummer | 174/36 |
| 3,519,796 | A | 7/1970 | Bebinger | |
| 3,936,107 | A * | 2/1976 | Gourdeau et al. | 312/329 |
| 4,032,821 | A * | 6/1977 | Keiser | 361/622 |
| 4,122,203 | A | 10/1978 | Stahl | |
| 4,901,676 | A | 2/1990 | Nelson | |
| 5,039,828 | A * | 8/1991 | Marks et al. | 174/135 |
| 5,366,185 | A * | 11/1994 | Michael et al. | 248/27.1 |
| 5,473,111 | A | 12/1995 | Hattori et al. | |
| 5,760,493 | A | 6/1998 | Outcalt et al. | |
| 2003/0205954 | A1 | 11/2003 | Oyler et al. | |
| 2008/0000506 | A1 | 1/2008 | Pyo et al. | |

(Continued)

FOREIGN PATENT DOCUMENTS

BR 199900315 2/1999

(Continued)

OTHER PUBLICATIONS

EP 0 944 147 Machine Translation Sep. 1999 EPO Mayer et al.*

(Continued)

*Primary Examiner* — Michael Barr
*Assistant Examiner* — Charles W Kling
(74) *Attorney, Agent, or Firm* — Alston & Bird LLP

(57) ABSTRACT

A protective arrangement for protecting a control device of a dishwashing appliance, and associated dishwashing appliance, are provided. A door assembly, comprising a tub-facing portion of a polymeric material and an opposing outwardly-facing portion, is pivotably engaged with and configured to cover a forward access opening defined by a tub portion of the dishwashing appliance. A control device mounted between the tub-facing and outwardly facing portions selectively directs operation of an operational component of the dishwashing appliance. The protective arrangement includes a protective member extending about the control device and at least partially between the control device and the tub-facing portion. The protective member is comprised of a fire-resistant layer for preventing a flame originating from the control device from interacting with the tub-facing portion, and a non-conductive layer disposed between the fire-resistant layer and the control device for preventing electrical contact between the fire-resistant layer and the control device.

38 Claims, 10 Drawing Sheets

U.S. PATENT DOCUMENTS

| | | | | |
|---|---|---|---|---|
| 2008/0134728 | A1 * | 6/2008 | Son | 68/212 |
| 2008/0196751 | A1 * | 8/2008 | Poyner et al. | 134/57 D |
| 2009/0288692 | A1 * | 11/2009 | Haeberle et al. | 134/58 D |

FOREIGN PATENT DOCUMENTS

| | | | |
|---|---|---|---|
| EP | 0 944 147 | A1 | 9/1999 |
| EP | 944147 | A1 * | 9/1999 |
| EP | 1 421 893 | A1 | 5/2004 |
| EP | 1 714 604 | A1 | 10/2006 |
| EP | 1 929 926 | A2 | 6/2008 |
| JP | 54065753 | A | 5/1979 |
| JP | 2006280402 | A | 10/2006 |
| WO | WO 02/02318 | A1 | 1/2002 |

OTHER PUBLICATIONS

Office Action for U.S. Appl. No. 12/164,568 dated Sep. 27, 2011.

* cited by examiner

PROTECTIVE ARRANGEMENT FOR A CONTROL DEVICE ASSOCIATED WITH A DISHWASHING APPLIANCE, AND ASSOCIATED APPARATUS AND METHOD

CROSS-REFERENCE TO RELATED APPLICATIONS

This application is a continuation-in-part of U.S. patent application Ser. No. 12/164,568, filed Jun. 30, 2008, the entire contents of which are hereby incorporated by reference.

BACKGROUND OF THE INVENTION

1. Field of the Invention

Embodiments of the present invention relate to dishwashing appliances and, more particularly, to a protective arrangement for protecting a control device associated with a dishwashing appliance, and an apparatus and method associated therewith.

2. Description of Related Art

A washing appliance, such as a dishwasher, generally includes a tub portion having a forward-facing vertical opening, wherein a door is engaged with the tub portion so as to be pivotable about the lower end of the tub portion and to close the tub opening during the washing process. In this regard, conventional dishwashers may include a door having a separate polymeric "inner lining" component (i.e., the inward surface of the door facing the interior of the tub portion). However, in such instances, if the polymeric inner lining is to be used for any structural purpose in the dishwasher, the inner liner must be appropriately reinforced by another separate structure. For example, a door assembly may include a plastic door liner and a metal reinforcement panel which is staked to the plastic door liner. In such instances, the metal reinforcement panel provides additional stiffness, strength, and provisions to which to attach various mechanisms and components, such as counterbalance arms/hinges for providing the pivotable engagement with the tub portion.

Such a dishwasher door assembly may also include a control panel engaged therewith about the upper end of the door assembly, often in a dedicated recess configured to receive the control panel in a confined space, wherein the control panel directs the operation/actuation of various operational components of the dishwasher. Such a control panel may include, for example, a timer device for controlling certain aspects of the dishwasher and/or a printed circuit board. The control panel/timer device/printed circuit board may be connected by an appropriate wiring harness run outside the metal reinforcement panel (i.e., the metal reinforcement panel separates the wires running to the control panel from the plastic or polymeric door liner) and routed over existing structures associated with the bottom of the door assembly, to the operative components of the dishwasher housed within a base component of the dishwasher under the tub portion.

Further, a dishwasher door configured in such a manner may use the metal reinforcement panel as a "flame barrier". That is, the metal reinforcement panel may act as a barrier for flame advancement should the control panel/timer device/printed circuit board catch on fire. However, the metal reinforcement panel may not necessarily be configured to prevent fluid leakage (i.e., from a detergent dispenser) from contacting the wiring harness, the control panel, the timer device, and/or the printed circuit board. A dedicated space defined by the metal reinforcement panel for receiving the control panel/timer device/printed circuit board may be particularly configured for this purpose. However, the metal reinforcement panel may not necessarily be configured to prevent fluid leakage from contacting the control panel/timer device/printed circuit board, wherein, in such instances, the fluid leakage contacting the control panel/timer device/printed circuit board may lead to the aforementioned fire hazard.

Alternatively, in some instances, a dishwasher may employ a door assembly formed without the separate metal reinforcement panel. For example, a molded structural inner door member may be implemented, wherein such an integrally molded and structurally reinforced inner door member eliminates the need for a separate metal reinforcing panel. However, in doing so, the "flame barrier" function of the metal reinforcement panel is eliminated, and the control panel/timer device/printed circuit board may still be at risk of undesirable contact with leaking fluids such as, for example, from the detergent dispenser.

Thus, there exists a need for an apparatus and method for a dishwashing appliance for reducing potential hazards/risks associated with a control panel/timer device/printed circuit board of a dishwasher.

BRIEF SUMMARY OF THE INVENTION

The above and other needs are met by the present invention which, according to one aspect, provides a dishwashing appliance, comprising a tub portion defining a forward access opening, and a door assembly configured to cooperate with the tub portion to cover the forward access opening, wherein the door assembly comprising a tub-facing portion operably engaged with an outwardly-facing portion. A control device is mounted to the door assembly between the tub-facing portion and the outwardly facing portion thereof, wherein the control device is adapted to selectively direct operation of at least one operational component of the dishwashing appliance. A protective member is configured to extend at least partially about the control device so as to be at least partially disposed between the control device and tub-facing portion of the door assembly. The protective member is comprised of a fire-resistant layer and a non-conductive layer. The fire-resistant layer is adapted to prevent a flame originating from the control device from interacting with the tub-facing portion of the door assembly. The non-conductive layer is disposed between the fire-resistant layer and the control device and is adapted to prevent electrical contact between the fire-resistant layer and the control device.

Another aspect provides a protective arrangement for a dishwashing appliance having a tub portion defining a forward access opening, and a door assembly configured to cooperate with the tub portion to cover the forward access opening. The door assembly comprises a tub-facing portion comprised of a polymeric material and is operably engaged with an outwardly-facing portion. A control device is mounted to the door assembly between the tub-facing portion and the outwardly facing portion thereof, wherein the control device is adapted to selectively direct operation of at least one operational component of the dishwashing appliance. Such a protective arrangement comprises a protective member configured to extend at least partially about the control device so as to be at least partially disposed between the control device and tub-facing portion of the door assembly. The protective member is comprised of a fire-resistant layer and a non-conductive layer. The fire-resistant layer is adapted to prevent a flame originating from the control device from interacting with the tub-facing portion of the door assembly. The non-conductive layer is disposed between the fire-resistant layer and the control device and is adapted to prevent electrical contact between the fire-resistant layer and the control device.

Thus, various aspects of the present invention provide advantages, as otherwise detailed herein, that may include, but are not limited to: providing protective measures for reducing hazards/risks associated with a control device of a dishwasher.

BRIEF DESCRIPTION OF THE SEVERAL VIEWS OF THE DRAWINGS

Figure 1:
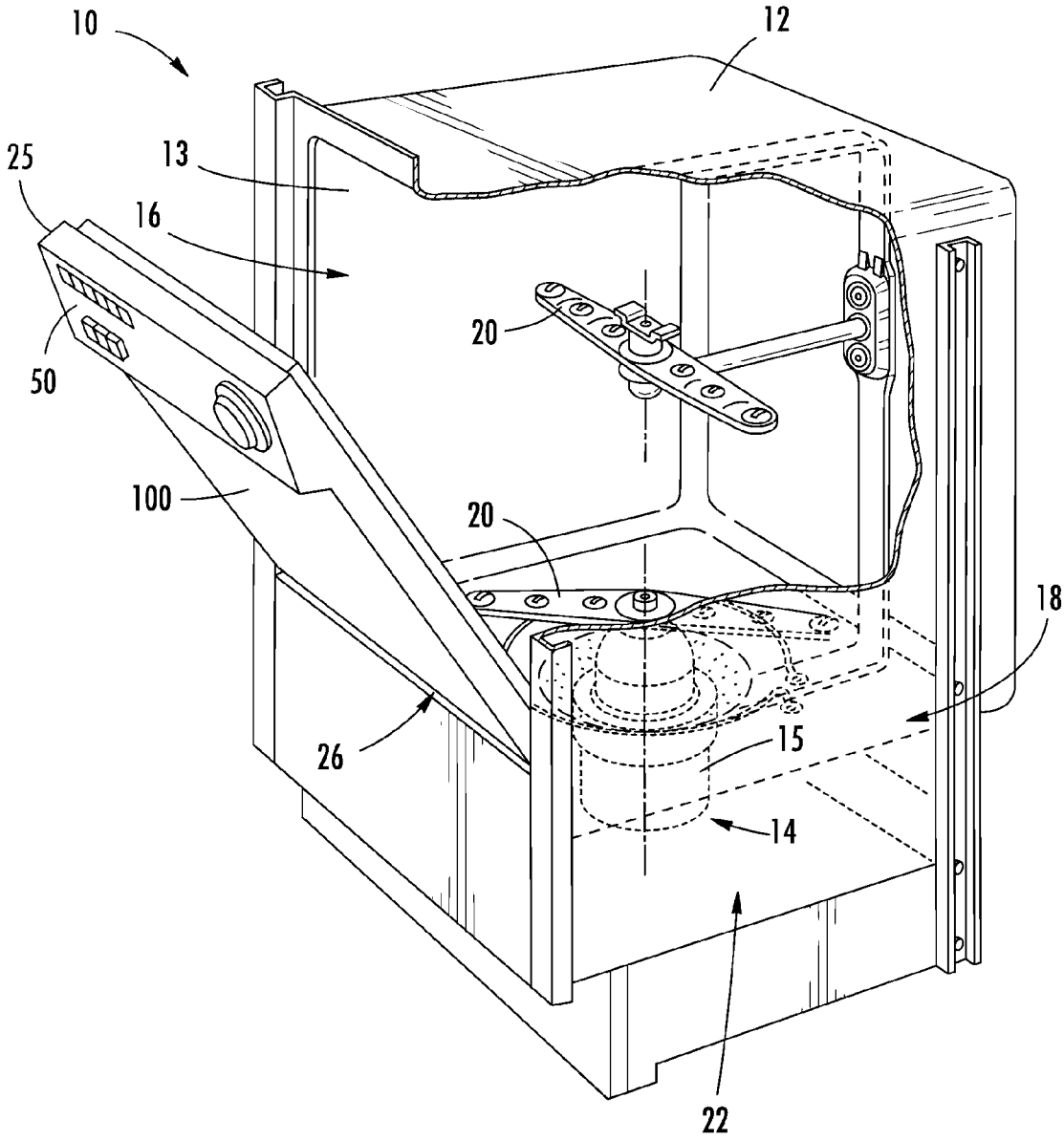
Figure 2:
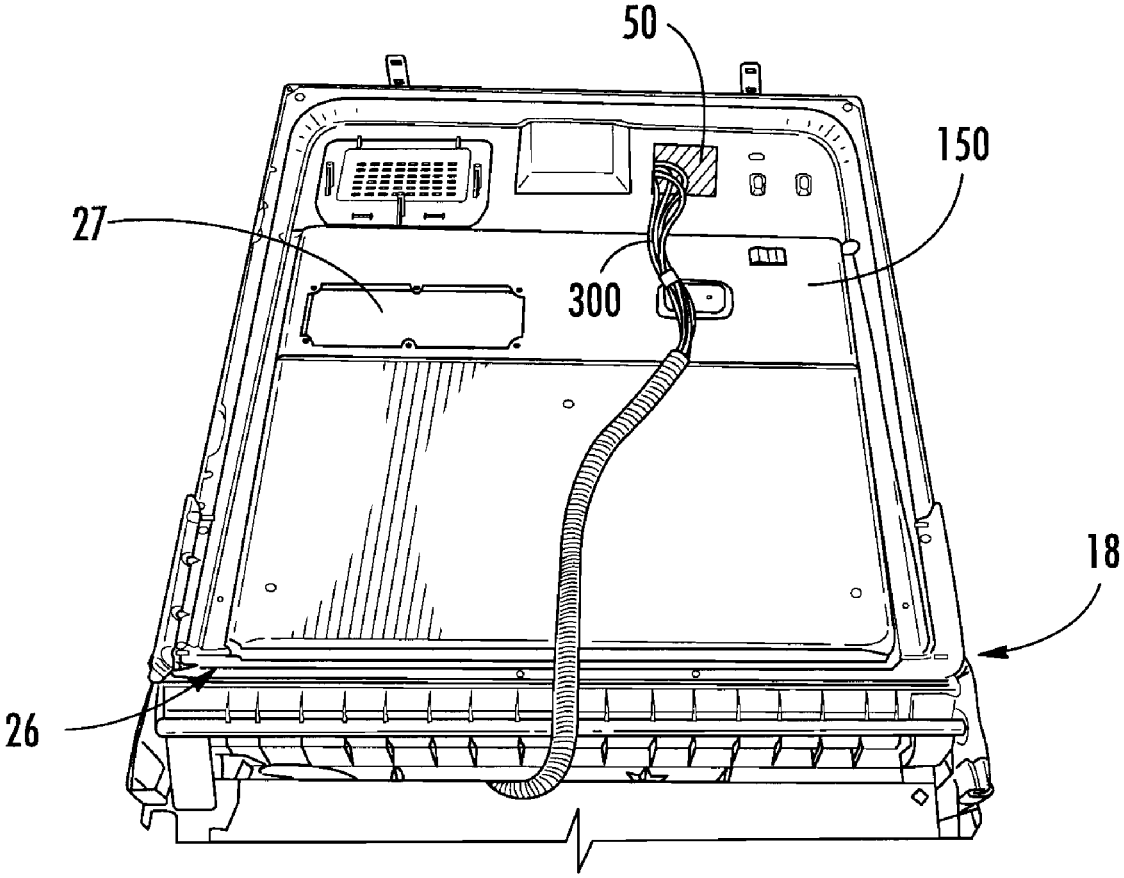
Figure 3:
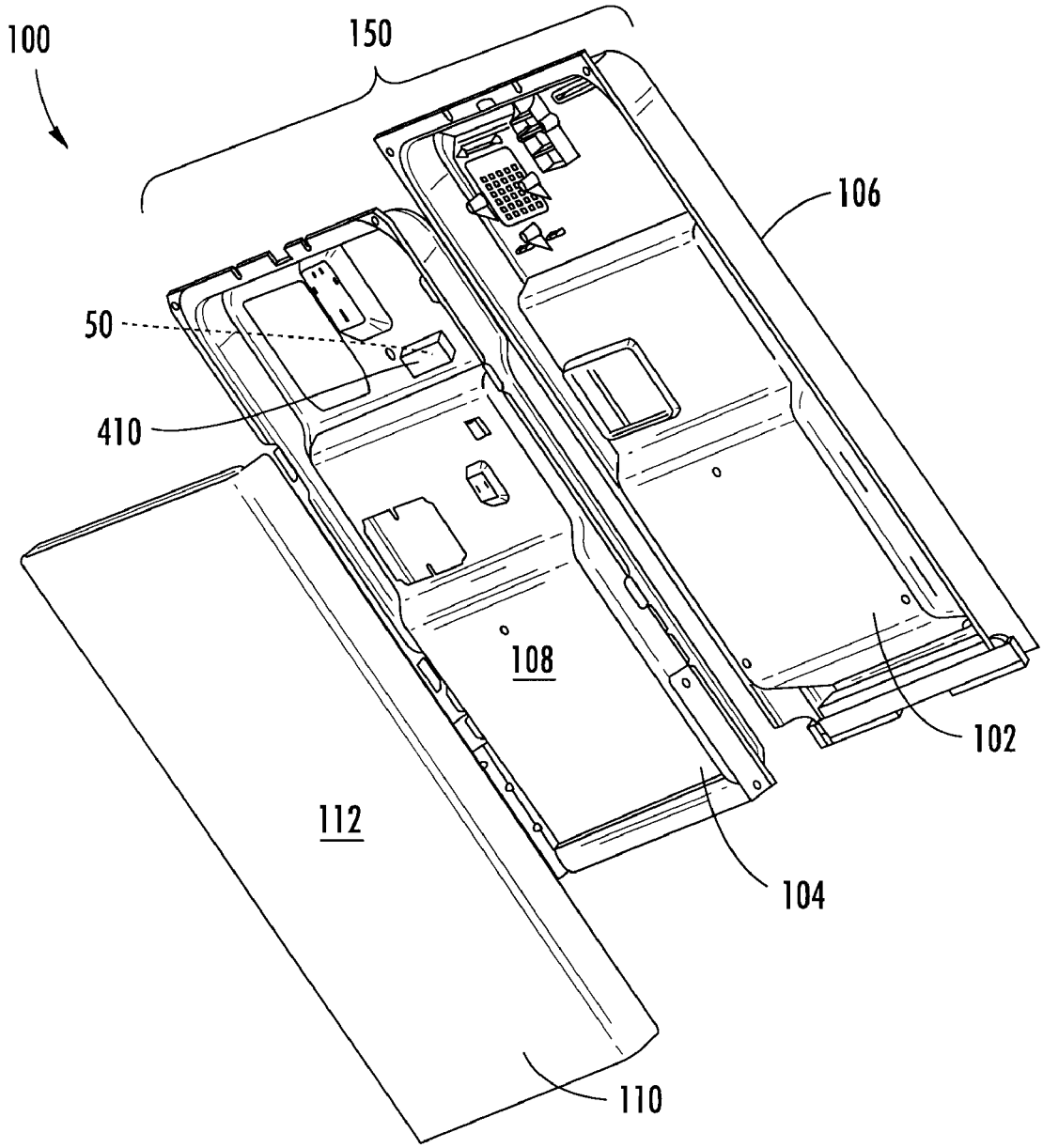
Figure 4:
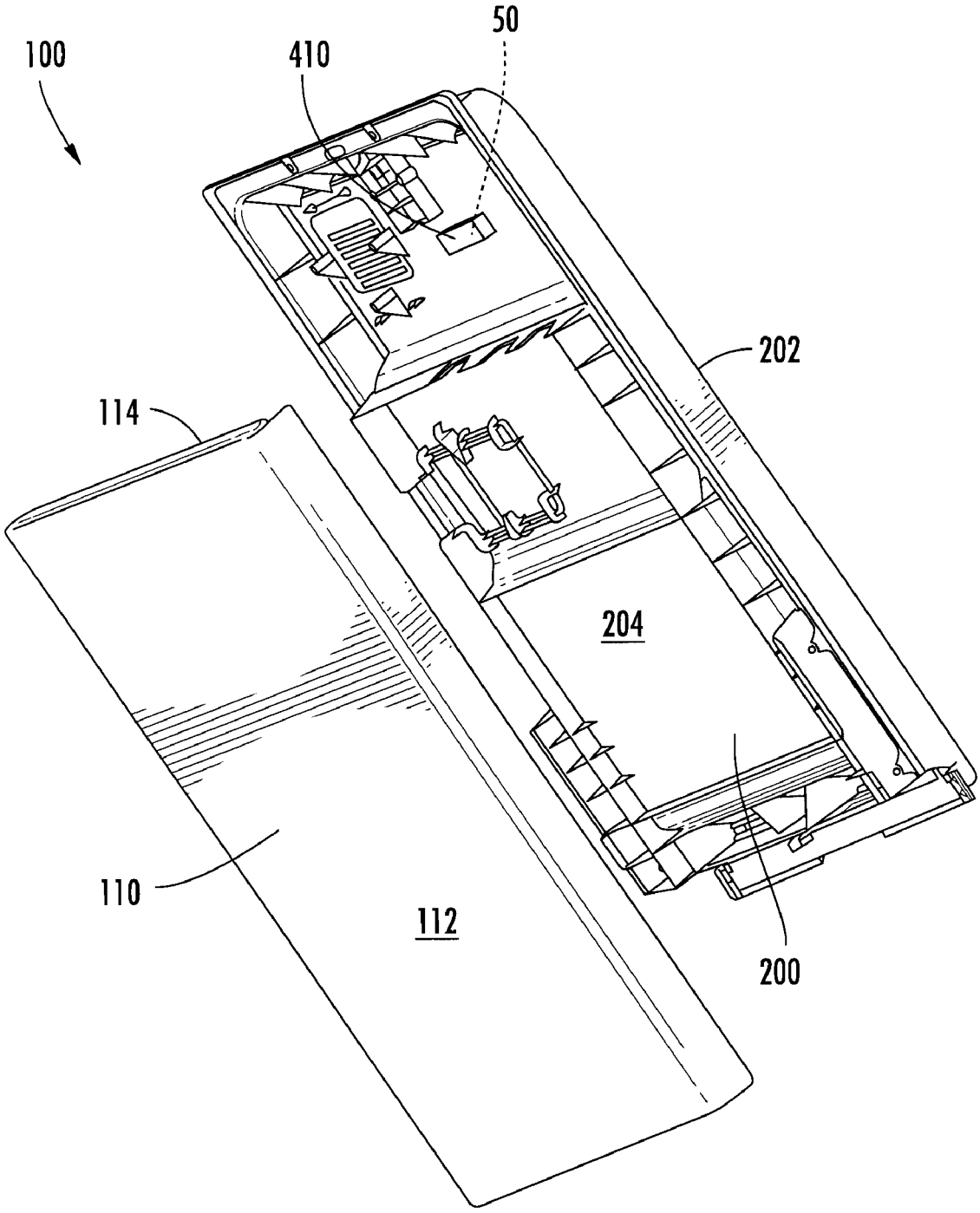
Figure 5:
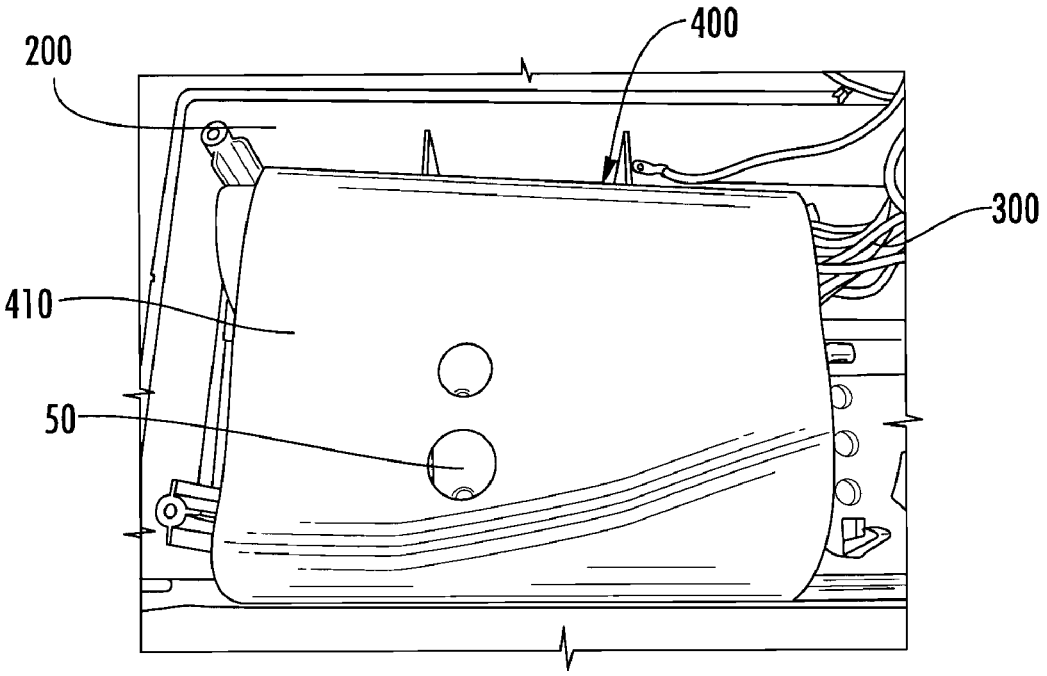
Figure 6:
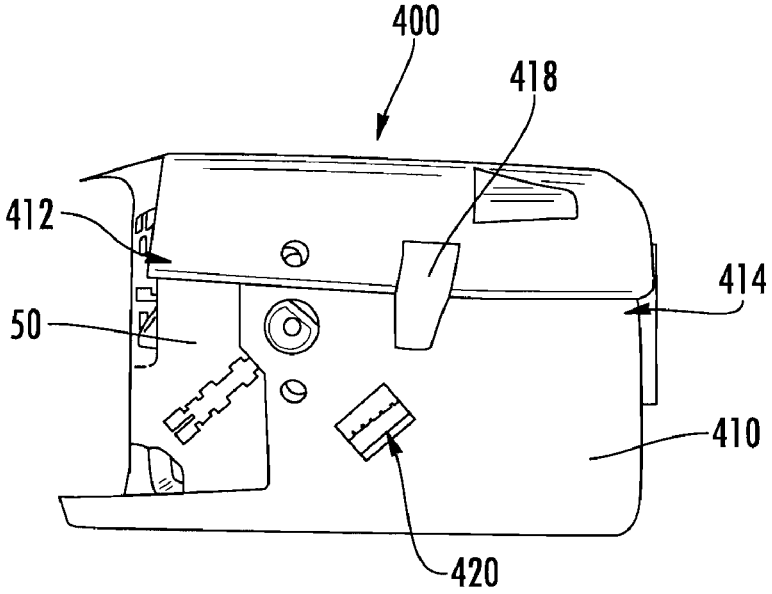
Figure 7:
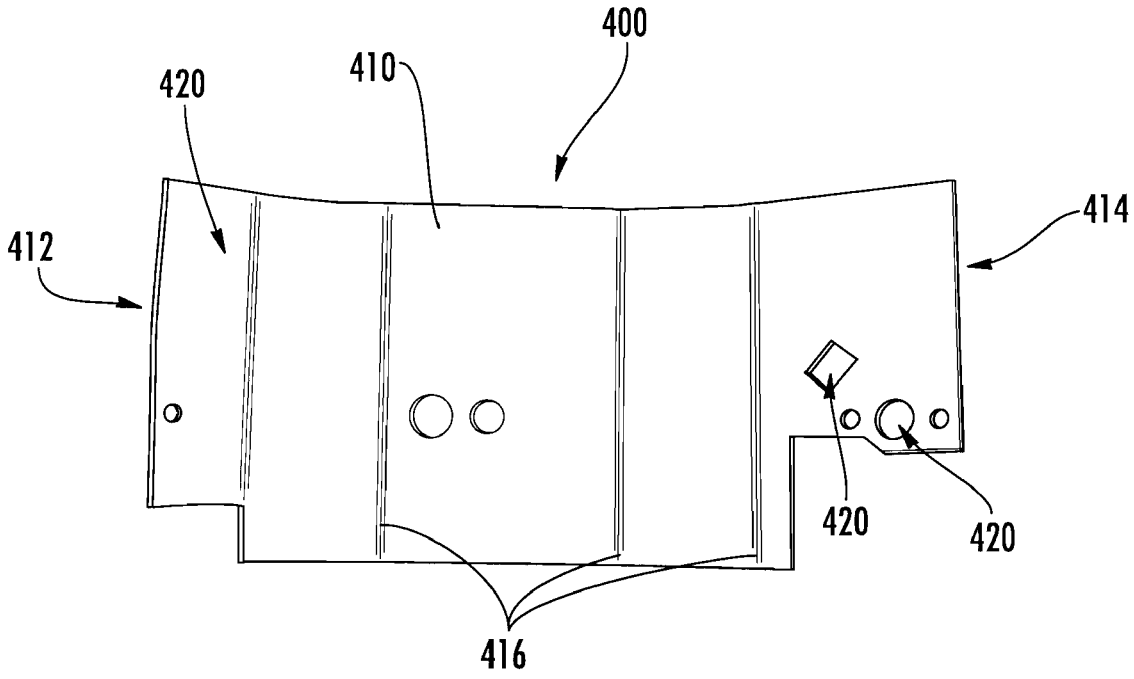
Figure 8:
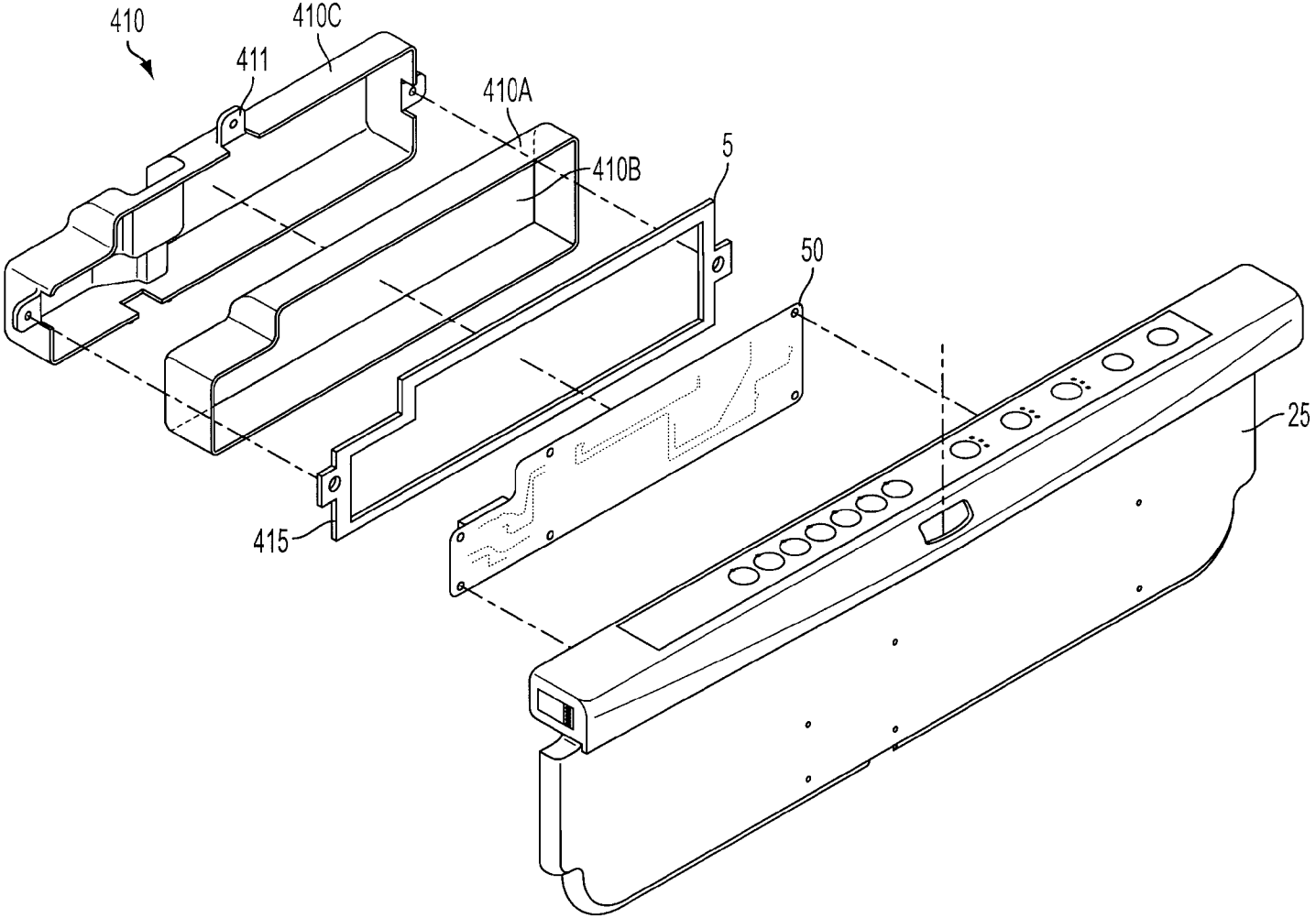

Having thus described various embodiments of the invention in general terms, reference will now be made to the accompanying drawings, which are not necessarily drawn to scale, and wherein:

FIG. 1 is a perspective view of a dishwasher capable of implementing various embodiments of the present disclosure;

FIG. 2 is a perspective view of a dishwashing appliance with an outer decorative door panel removed from a door assembly so as to illustrate a wiring arrangement extending from a control device associated with the door assembly to various operational components housed in a base component of the dishwashing appliance;

FIG. 3 is an exploded perspective front view of a door assembly having a protective arrangement, according to one embodiment of the present invention, for protecting a control device mounted to the door assembly, wherein the door assembly implements a liner panel and a separate reinforcement panel;

FIG. 4 is an exploded perspective front view of a door assembly having a protective arrangement, according to one embodiment of the present invention, for protecting a control device mounted to the door assembly, wherein the door assembly implements an integrally-formed inner door panel;

FIG. 5 is a top plan view of a protective arrangement covering a control device mounted to a door assembly, according to one embodiment of the present invention;

FIG. 6 is a bottom plan view of a protective arrangement extending about a control device to be implemented in association with a door assembly of a dishwasher, according to one embodiment of the present invention;

FIG. 7 is a plan view of a protective arrangement according to one embodiment of the present invention;

FIG. 8 is a schematic of a partial door assembly for a dishwashing appliance having a protective arrangement, according to one embodiment of the present invention, for protecting a control device mounted to the door assembly;

FIGS. 9-12 illustrate various forms of a protective arrangement for extending about a control device to be implemented in association with a door assembly of a dishwashing appliance, according to some embodiments of the present invention; and FIGS. 13A-13D illustrate partial cross-sectional views of various forms of a protective arrangement for extending about a control device to be implemented in association with a door assembly of a dishwashing appliance, according to some embodiments of the present invention.

DETAILED DESCRIPTION OF VARIOUS EMBODIMENTS OF THE INVENTION

Various embodiments of present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates one example of a dishwasher 10 capable of implementing various embodiments of the present invention. Such a dishwasher 10 typically includes a tub portion 12 (partly broken away in FIG. 1 to show internal details, and also referred to herein as "tub" or "tub 12") having a plurality of walls (e.g., side wall 13) for forming an enclosure in which dishes, utensils, and other dishware may be placed for washing. The tub portion 12 may also define a forward access opening, generally designated as 16. As known in the art, the dishwasher 10 may also include slidable bottom and upper racks (not shown) for holding the dishes, utensils, and dishware. The tub portion 12 may define a sump, generally designated as 14, in which wash water or rinse water is collected, typically under the influence of gravity. The wash/rinse water may be pumped by a pump 15 out of the sump 14 to various spray arms 20 mounted in the interior of the tub portion 12 for spraying the wash/rinse water, under pressure, onto the dishes, utensils, and other dishware contained therein. The pump 15 and/or other operational components (e.g., circulation pump, drain pump, water valve) may be housed, disposed, or otherwise positioned within a base portion/component 22 positioned beneath the tub portion 12, wherein the base portion 22 receives and supports a lower end, generally designated as 18, of the tub portion 12. In some instances, the base portion 22 may be a separate component with respect to the tub portion 12, such as, for example, a molded polymer component, while in other instances the base portion 22 may be integral with the tub portion 12 such that the side walls forming the tub portion 12 also at least partially form the base portion 22.

A door assembly 100 may be pivotably engaged with the tub portion 12 about the lower end 18 thereof so as to selectively permit access to the interior of the tub portion 12. That is, a lower edge 24 of the door assembly 100 may be pivotably engaged (i.e., hinged) with the lower end 18 of the tub portion 12 such that the door assembly 100 is pivotable about the lower edge 26 thereof to provide access to the interior of the tub portion 12 through the forward access opening 16, and to cover and seal the forward access opening 16 when the dishwasher 10 is in operation. Examples of such door assemblies 100 are also illustrated in FIGS. 3 and 4. A detergent dispensing device 27 (FIG. 2) may be operably engaged with the door assembly 100 so as to be capable of interacting with dishwashing fluid circulated within an interior of the tub portion 12.

As illustrated in FIGS. 1 and 2, the dishwasher 10 may further include a control device 50. The control device 50 may include, for example, a circuit board, a control panel, a timer device or other control unit (for controlling certain aspects of the dishwasher 10) that is otherwise in electrical communication with one or more controller elements and/or user interfaces, which may be mounted in/on the door assembly 100 (i.e., control switches mounted to the top of the door assembly 100 or the front of the door assembly 100) of the dishwasher 10 or otherwise associated with the door assembly 100. The control device 50 may further be in communication, via a wiring arrangement 300, such as, for example, a wiring harness, with various operational components (e.g., circulation pump, drain pump, water valve) of the dishwasher 10, wherein such operational components may thus be controlled via the control device 50, as initiated through the controller elements and/or user interfaces mounted on the door assembly 100. In some instances, the operational components may be disposed within or proximate to the base portion 22 such that the wiring arrangement 300 extends from about the top portion of the door assembly 100 and along the door assembly 100 to the base portion 22.

With continuing reference to FIG. 2, according to some embodiments, the control device 50 may be engaged with the door assembly 100 about the upper end thereof. For example, in some instances, the control device 50 may be engaged with the door assembly 100 in a dedicated recess (not shown) configured to receive the control device 50 in a defined space (for example, when the control device 50 is a control panel and/or a timer device). The control device 50, in such instances, may be connected by an appropriate wiring arrangement 300 run outside an inner door panel 150 and routed over existing structures associated with the bottom portion 26 of the door assembly 100 and/or the lower end 18 of the tub portion 12, to the operative components of the dishwasher 10 housed within the base portion 22 of the dishwasher 10 under the tub portion 12. As such, the wiring arrangement 300 (e.g., a wiring harness) may extend along the door assembly 100 to provide an electrical connection between the control device 50 and the operational components.

As shown in FIG. 3, the control device 50 may be configured for use and association with a door assembly 100 of a dishwasher 10, the door assembly 100 having an inner door member 150 (otherwise referred to herein as "inner door panel 150") comprising a liner panel 102 and a separate reinforcement member 104, wherein the liner panel 102 and the reinforcement member 104 are fastened together and configured for attachment to the tub portion 12 (FIG. 1) of the dishwasher 10 (FIG. 1). The liner panel 102 may be comprised of a polymeric material to form a polymeric inner lining, wherein the visible side 106 of the liner panel 102 when coupled to the reinforcement member 104 (e.g., by screws, rivets or the like) forms the inward surface of the inner door panel 150 facing the interior of the tub portion 12. Since, the polymeric liner panel 102 is generally flexible, the reinforcement member 104 is coupled to the liner panel 102 so as to reinforce the liner panel 102 and to provide structural integrity thereto. Accordingly, the reinforcement member 104 may comprise a metal material, wherein the metal reinforcing panel can be staked to the polymeric inner panel 102 for providing structural rigidity thereto. In such a configuration, a first surface 108 of the reinforcement member 104 faces outwardly from the interior of the tub 12. In such door assemblies, the control device 50 may be at least partially disposed externally to the reinforcement member 104 with respect to the inner panel 102 such that the reinforcement member 104 provides a "flame barrier" between the control device 50 and the inner panel 102. In such instances, however, the reinforcement member 104 may not necessarily be configured to prevent fluid leakage (e.g., from the detergent dispensing device 27) from contacting the control device 50, wherein, in such instances, the fluid leakage contacting the control device 50 may lead to a fire hazard.

With continuing reference to FIG. 3, the door assembly 100 may further include a decorative panel 110 for providing an exterior viewable and/or decorative portion of the door assembly 100. Thus, an exterior surface 112 of the decorative panel 110 is configured to face outwardly of the interior of the tub portion 12 so as to provide an aesthetically configured door assembly 100. The outer panel 110 may be configured to attach to the inner door panel 150 (i.e., the combined liner panel 102 and reinforcement member 104) such that the metal reinforcement member 104 is disposed therebetween. In this manner, the reinforcement member 104 may be concealed within the door assembly 100 formed between the liner panel 102 and the outer panel 110. The outer panel 110 is typically comprised of, for example, a polymeric material, a wood material or a metal material such as stainless steel. In such door assemblies, the control device 50 may be at least partially disposed between the reinforcement member 104 and the decorative panel 110, wherein one or more controller elements and/or user interfaces may be included or otherwise associated with the door assembly 100 for actuating various operational components of the dishwasher 10 via the control device 50. One of ordinary skill in the art will appreciate that, in some instances, the control device 50 may be mounted to, secured to, or otherwise engaged with the decorative panel 110 rather than the reinforcement member 104 or other component of the door assembly 100.

In other instances, as shown in FIG. 4, the control device 50 may be configured for use and association with a door assembly 100 comprising an integrally-formed and structurally reinforced door panel member 200 and the decorative panel 110, wherein the inner door panel member 200 (otherwise referred to herein as "inner door panel 200") and the decorative panel member 110 (otherwise referred to herein as "decorative panel 110") may be configured to be operably engaged or secured together to form the door assembly 100. When secured together, the decorative panel 110 is externally disposed to the inner door panel 200, with respect to the interior of the tub portion 12, wherein the decorative panel 110 and the inner door panel 200 may be configured to cooperate to define a space therebetween such that the control device 50 may be at least partially disposed therein.

Such an inner door panel 200 may be comprised of a variety of different polymers and/or composite materials. For example, the inner door panel 200 may be integrally formed as a single component or otherwise integral structure (i.e., integrally-molded using materials that may include, but are not limited to: polymers and composite materials, such as, for example, a molded polymer panel or a fiberglass panel). For example, the inner door panel 200 may be integrally-molded or otherwise integrally-formed from a polymeric material, such as talc-filled polypropylene. As shown generally in FIG. 4, the inner door panel 200 may comprise one or more integrally-molded members or component mounting structures that cooperate to receive and/or secure at least one or a variety of operative components thereto. For example, the inner door panel 200 may include integrally-formed mounting provisions for mounting, securing, or otherwise maintaining the control device 50 in connection with the door assembly 100. That is, the inner door panel 200 may be integrally formed, using heat, pressure, adhesive materials, and/or other composite material processing steps that will be appreciated by one skilled in the art such that the inner door panel 200 may be provided in substantially one piece (i.e., as a "single-piece" component), wherein no separate reinforcement panel or fasteners are required to form the inner door panel 200. One of ordinary skill in the art will appreciate that, in some instances, the control device 50 may be mounted, secured, or otherwise engaged to the decorative door panel 110 rather than the inner door panel 200.

In some embodiments, the inner door panel 200 may have a tub-facing liner surface 202 and a structural surface 204, wherein the liner surface 202 is positioned to be disposed toward the tub portion of the dishwashing appliance and the structural surface 204 generally opposes the liner surface 202 and faces outwardly therefrom. Thus, the structural surface 204 substantially opposes an interior surface 114 of the decorative panel 110 when coupled therewith to form the door assembly 100. The structural surface 204 may include one or more reinforcing members integrally-formed therewith for providing support and structure (i.e., reinforcement) to the inner door panel 200. The integrally-formed inner door panel 200 may thus stand on its own as a structural door assembly (thus, eliminating the need for the separate metal reinforcement member 104) capable of pivotably engaging the tub portion 12 of the dishwasher 10, wherein the decorative panel 110 is substantially non-structural and is provided essentially for appearance purposes. Accordingly, in some instances, the control device 50 may be at least partially disposed between the structural surface 204 and the interior surface 114 of the decorative door panel 110. However, in eliminating the metal reinforcement member 104 from the door assembly 100, the "flame barrier" function of the metal reinforcement member 104 is also substantially eliminated, and the control device 50 may still be at risk of undesirable contact with leaking fluids such as, for example, from the detergent dispenser 27 associated with the door assembly 100.

In accordance with embodiments of the present disclosure, with reference to FIGS. 5-7, the dishwasher 10 may thus include a protective arrangement 400 for the control device 50, the protective arrangement 400 comprising a protective member 410 for providing protection and/or isolation for the control device 50 mounted to the door assembly 100. As mentioned previously, the control device 50 may be exposed to various hazardous conditions when disposed within or otherwise associated with the door assembly 100. For example, fire or chemical exposure may severely damage the control device 50, possibly causing electrical issues/hazards. Alternatively, fire hazards may originate from the control device 50, wherein such hazards should be appropriately contained. Accordingly, the protective member 410 may be configured to provide appropriate protection and isolation for the control device 50 for reducing such risks.

In some instances, the protective member 410 may be substantially planar and comprised of a deformable material such that the protective member 410 can at least partially extend about or otherwise surround, cover, and/or wrap about the control device 50 (which may include, for example, a control panel and/or timer device) to provide protection therefor. In such instances, the protective member 410 may include a first/leading end 412 and a second/trailing end 414, wherein the leading end 412 extends about the control device 50 such that the leading end 412 at least partially overlaps the trailing end 414. In other instances, the leading end 412 and the trailing end 414 may not overlap, but instead extend proximate to one another. As such, the protective member 410 may be at least partially disposed between the control device 50 mounted to the door assembly 100, as well as at least partially disposed between the control device 50 and the detergent dispensing device 27 (FIG. 2), so as to protect and/or isolate the control device 50 (i.e., protect the control device 50 from leaking fluid from the detergent dispensing device 27).

In some instances, the protective member 410 may define at least one crease 416 or other substantially linear portion for facilitating deformation of the protective member 410 along a defined line, which therefore facilitates wrapping of the protective member 410 about the control device 50. Furthermore, in some embodiments, the leading end 412 may be coupled to the trailing end 414 by a coupling member(s) 418 or other appropriate fastener, which may include, for example, an adhesive tape, a screw, a rivet, or other suitable fastening member, for maintaining the protective member 410 in position about the control device 50. The protective member 410 may be sufficiently thin so as to not interfere with the fit of the control device 50 within the dedicated, defined space of the door assembly 100, but may also be sufficiently flexible and robust so as to maintain its shape, size, and arrangement with respect to the control device 50 during manufacture and assembly of the dishwasher 10. The protective member 410 may be provided as a single component formed, for example, by a stamping process or other streamlined process, such that ease of assembly of the protective member 410 about the control device 50 can be improved.

Further, the protective member 410 may be suitably configured to receive therethrough projections or other structures projecting from the control device 50. For example, the protective member 410 may define one or more apertures, recesses, or cut-away portions such that the protective member 410 is capable of surrounding the control device 50 while suitably accommodating structural features of the control device 50. In some instances, for example, the protective member 410 may further define at least one aperture 420 for receiving a mounting device (not shown) therethrough for mounting the protective member 410 to the door assembly 100 or to receive a wiring arrangement 300 or other connector portions extending through the protective member 410 for connecting to (electrically or otherwise) or otherwise operably engaging the control device 50.

As mentioned previously, the protective member 410 may be comprised of a deformable material such that the protective member 410 may be appropriately deformed to be wrapped about the control device 50. Accordingly, the protective member 410 may be comprised of a durable, but appropriately flexible and/or durable material so as to permit at least partial wrapping of the protective member 410 about the control device 50. In some instances, the protective member 410 may be comprised of a composite film, such as, for example, a Mylar®/aluminum composite film that is, for example, deformable, durable, flexible, water-resistant, and/or flame-resistant. Such a composite film may be further configured to wrap or otherwise extend about the control device 50 so as to at least partially protect the control device 50 from contact with leaking fluid from the dishwasher 10 (i.e., from the detergent dispensing device 27), wherein the composite film may also be at least partially disposed between the control device 50 and the inner door member 150 or 200 so as to provide a "flame barrier" therebetween.

According to some embodiments, the protective member 410 may be comprised of a flame-resistant material, a chemical-resistant material, and/or a chafe-resistant material. As such, the protective member 410 may isolate the control device 50 from surrounding components/portions associated with the dishwasher 10 so as to reduce risk of damage/injury from fire, chemical, and chafing sources. Particularly, in instances where the door assembly 100 implements an integrally formed inner door panel 200, the protective member 410 may reduce/prevent fire, chemical and/or chafing damage to the control device 50, as well as restrict fires originating at the control device 50 from advancement to the inner door panel 200. That is, because the door assembly 100 having the integrally formed inner door panel 200 does not include the metal reinforcement member 104 (FIG. 3) for providing a "flame barrier," the protective member 410 may extend about, wrap or otherwise surround the control device 50 in an encompassing manner to provide such protection for the control device 50, while also acting as a flame barrier to contain or otherwise restrict a fire originating from the control device 50. Such a protective member 410 may eliminate the need for a separate flame barrier provision. In such instances, the protective member 410 may extend about the control device 50 so as to be at least partially disposed between the inner door panel 200 and the control device 50 and therefore provide such a flame barrier therebetween, in the absence of a separate metal reinforcement member 104 (FIG. 3).

Further, the protective member 410 may be configured to be water resistant and/or chemical resistant so as to be capable of reducing exposure of the casing, housing or other surrounding portion of the control device 50 to water and/or chemical exposure (i.e., due to rinse aid/dishwashing detergent/dishwashing fluid leaking from a detergent dispensing device 27 (FIG. 2), or to water intrusion from the interior of the tub into the space between the inner door panel 150 or 200 and the decorative panel 110) which could potentially cause a fire hazard. Thus, the protective member 410 may be particularly useful for preventing/reducing the risk of such water and/or chemical exposure of the control device 50 associated with door assemblies 100 for dishwashers employing either an inner door panel 150 with a separate reinforcement member 104, or inner door panel 200 without the reinforcement member 104, as shown in FIGS. 3 and 4, respectively.

The term "flame-resistant" material as used herein is defined as a material capable of substantially withstanding elevated temperatures, such as those associated with fire, such that the material maintains its structural integrity for containing a fire, preventing or otherwise limiting the advancement thereof, and/or preventing the fire from damaging structures surrounded by the material. For example, the protective member 410 may be constructed of a material having a UL94-HBF flammability rating. In some instances, the protective member 410 may be constructed of a suitable composite material such as, for example, a Mylar®/aluminum composite film or any other suitable material.

The term "chemical-resistant" material as used herein is defined as a material capable of substantially withstanding degradation, disintegration and/or destruction when exposed to chemicals that may be associated with a dishwashing appliance. For example, the protective member 410 may be constructed of a material resistant to the deteriorating effects of rinse aid agents. For example, the protective member 410 may be constructed of a suitable composite material such as, for example, a Mylar®/aluminum composite film or any other suitable material.

The term "chafe-resistant" material as used herein is defined as a material capable of substantially withstanding destruction and/or degradation caused by frictional forces from a structure/feature rubbing, chaffing, contacting or otherwise acting thereon. For example, the protective member 410 may be constructed of a chafe-resistant and durable composite material such as a Mylar®/aluminum composite film or any other suitable material.

FIG. 8 illustrates yet another aspect of the present invention, wherein the door assembly 100 is configured to cooperate with the tub 12 to cover the forward access opening 16. In such instances, the door assembly 100 may comprise a tub-facing portion, such as the inner door panel 200, operably engaged with an outwardly-facing portion, such as the decorative panel 110, or a console member 25 engaged with the door assembly 100 about the upper end thereof and having at least a portion disposed between the inner door panel 200 and the decorative panel 110. In conjunction with such instances, the control device 50, in some aspects, may comprise a circuit board or other electronic assembly mounted to the door assembly 100, for example, to the console member 25, between the tub-facing portion and the outwardly facing portion of the door assembly 100. As previously discussed, the control device 50 may be configured to cooperate with one or more controller elements and/or user interfaces otherwise associated with the door assembly 100 for actuating various operational components of the dishwasher 10 via the control device 50.

In aspects of the present invention, as shown in FIG. 8, the protective arrangement 400 may include a protective member 410 configured to extend at least partially about the control device 50, such as the circuit board shown in FIG. 8, such that the protective member 410 is at least partially disposed between the control device 50 and tub-facing portion (inner door member 200) of the door assembly 100. In such aspects, the protective member 410 may be comprised of a fire-resistant layer 410A (see, e.g., FIGS. 13A-13D) and a non-conductive layer 410B (see, e.g., FIGS. 13A-13C). One purpose of the fire-resistant layer 410A is to prevent any flame originating from the control device 50 from interacting with the tub-facing portion (inner door panel 200) of the door assembly 100, for example, in instances where the integrally formed inner door panel 200 is comprised of a polymeric material, or other material which may not necessary be heat resistant and/or flame resistant, and does not include the metal reinforcement member 104 (FIG. 3) for providing such a "flame barrier" provision. The non-conductive layer 410B may be comprised of a polymeric material and is configured to be disposed between the fire-resistant layer 410A and the control device 50 so as to prevent any electrical contact between the fire-resistant layer 410A and the control device 50. That is, in some instances, the space between the fire-resistant layer 410 and the control device 50 (circuit board) may be limited. Further, the fire-resistant layer 410A may sometimes be comprised of a metallic material that may be conductive, and the control device 50 (circuit board) may include exposed electrical current-carrying parts. As such, one purpose of the non-conductive layer 410B is to prevent any short circuits that may be caused by inadvertent contact between the fire-resistant layer 410A and the control device 50. In some instances, such a protective member 410 may be comprised of a composite film, such as, for example, a Mylar®/aluminum composite film that is, for example, deformable, durable, flexible, water-resistant, heat-resistant, and/or flame-resistant.

Since the fire-resistant layer 410A/nonconductive layer 410B composite film may be deformable and/or flexible, in some aspects, the protective member 410 may further comprise a structural element 410C associated with the fire-resistant layer 410A and/or the non-conductive layer 410B. That is, in some instances, the fire-resistant layer 410A and, in some instances, the nonconductive layer 410B, may be further associated with a structural element 410C for rigidifying the protective member 410. In some aspects, the structural element 410C may be comprised of a polymeric material, or other suitable material providing the rigidifying property as well as being chemical resistant and chafe resistant, such as a molded thermoplastic. As further shown in FIG. 8, the control device 50 (circuit board) may, in some aspects, be mounted to the outwardly-facing portion of the door assembly 100 (console member 25). In such instances, the protective member 410 may be configured to extend about the control device 50 and to engage the console member 25 so as to substantially enclose the control device 50 therebetween. In some aspects, the structural element 410C may comprise, for example, a molded thermoplastic housing defining at least one aperture 411 configured to receive a mounting device therethrough (as shown, for example, in FIGS. 8 and 12) for mounting the protective member 410 to the door assembly 100 and/or to receive wiring therethrough for electrical connection to the control device 50. In some aspects, a sealing member 415, such as a gasket formed from an appropriate gasket material, may be configured to extend or otherwise be disposed between the protective member 410 (i.e., the structural element/housing 410C) and the console member 25 so as to form a substantially sealed enclosure about the control device 50.

The protective member 410 and the sealing member 415 may thus also cooperate, for example, to at least partially prevent contact between dishwashing fluid from the detergent dispensing device 27 and the control device 50, as previously disclosed.

Figure 9:
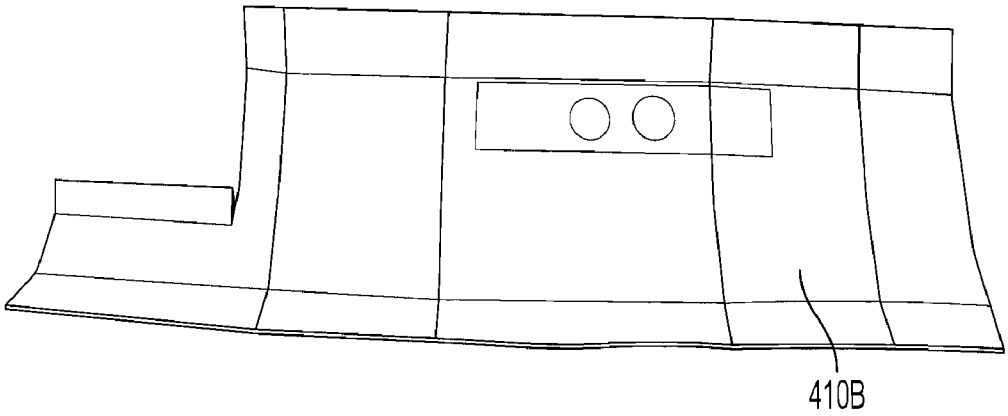
Figure 10:
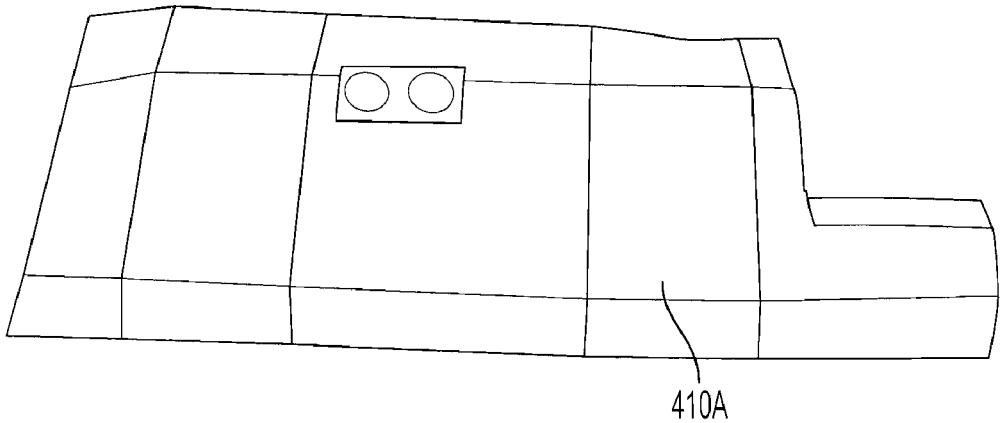
Figure 11:
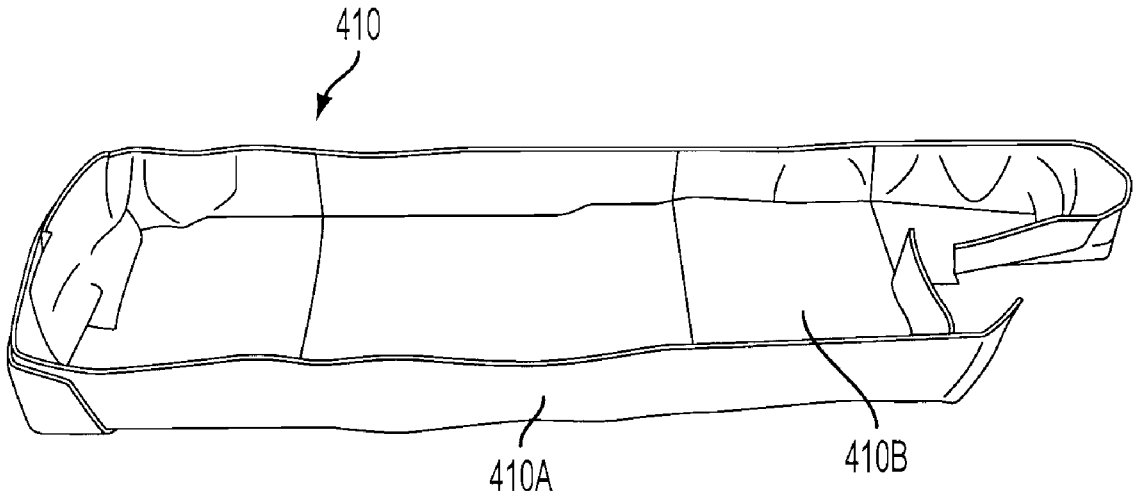
Figure 12:
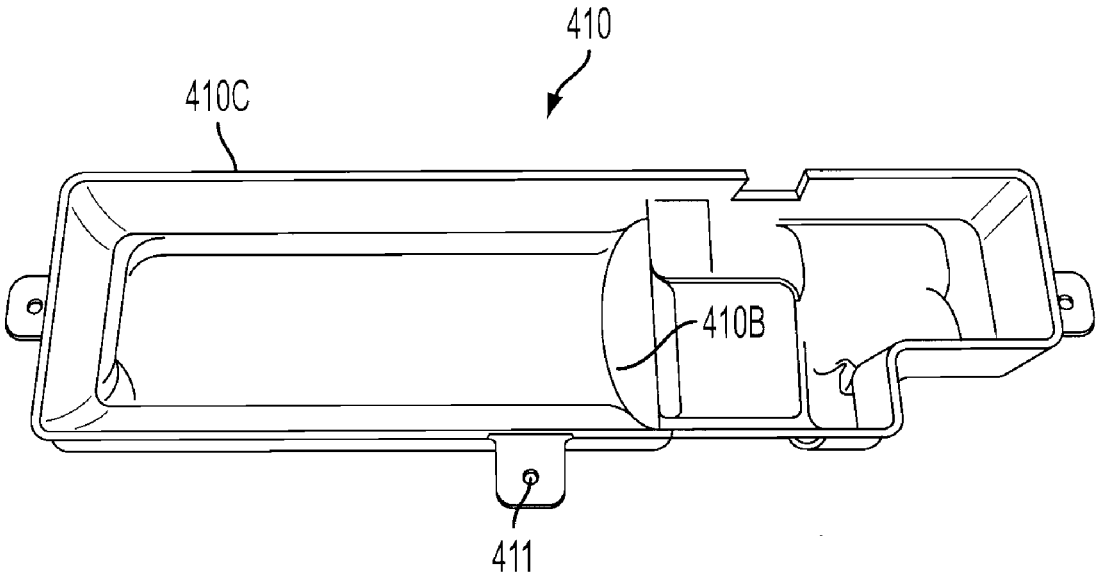

As shown in FIGS. 9 and 10, in some instances, the fire-resistant layer 410A and the non-conductive layer 410B (i.e. a Mylar®/aluminum composite film) may be substantially planar and comprised of a deformable material that can be shaped, as shown, for example, in FIG. 11, to extend about the control device 50 (which may include, for example, a control panel and/or timer device) to provide protection therefor. In being so configured, the fire-resistant layer 410A and the non-conductive layer 410B (i.e. a Mylar®/aluminum composite film) may, in some instances, define at least one crease or other substantially linear portion for facilitating deformation of the film along a defined line into the shape shown, for example, in FIG. 12. In some instances, as shown, for example, in FIG. 12, the fire-resistant layer 410A and the non-conductive layer 410B (i.e. a Mylar®/aluminum composite film) may be shaped, as shown, for example, in FIG. 11, to extend about the control device 50, as well as to be inserted, in substantially conformable into the structural element/housing 410C. In this manner, the protective member 410 comprising the fire-resistant layer 410A, the non-conductive layer 410B (i.e. a Mylar®/aluminum composite film), and the structural element/housing 410C may be jointly applied to substantially enclose the control device 50, as previously discussed. One skilled in the art will appreciate, however, that, in some instances, that the structural element 410C may not be necessary or included, wherein the aforementioned aspects thereof may be provided by the fire-resistant layer 410A and/or the non-conductive layer 410B, as appropriate or desired. Further, one skilled in the art will appreciate that, in some instances, the fire-resistant layer 410A and the non-conductive layer 410B, and optionally the structural element/housing 410C, may be integrally formed as either a planar or shapable sheet, or in the appropriate or desired form/shape for application to the control device 50, as discussed herein, using, for example, a stamping process or a molding process (i.e., including vacuum forming, overmolding, and insert molding), such that ease of assembly of the protective member 410 about the control device 50 can be improved.

Figure 13A:
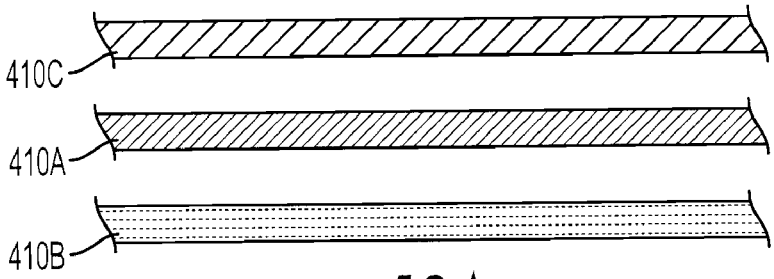
Figure 13B:
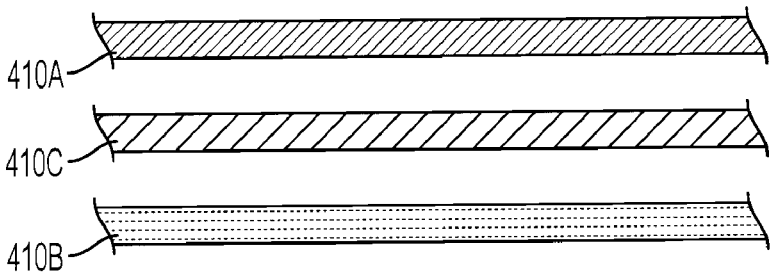
Figure 13C:
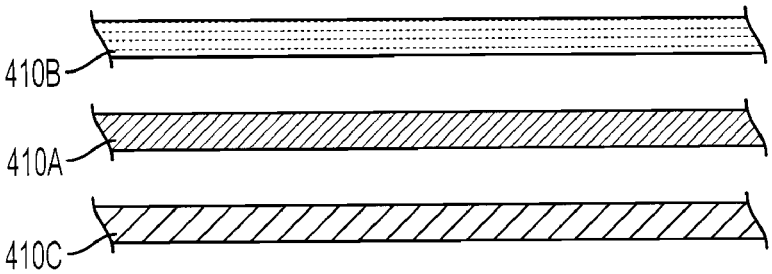
Figure 13D:
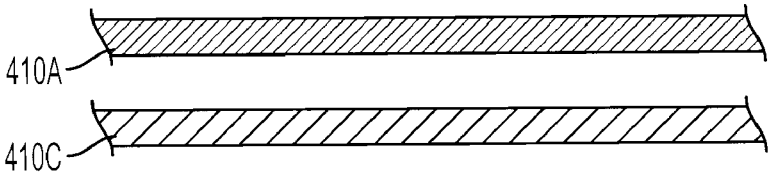

One skilled in the art will also appreciate that the protective member 410 may be comprised of a plurality of layers that may be arranged in different manners. For example, as shown in FIG. 13A, the protective member 410 may be configured such that the structural element 410C comprises a structural layer disposed between the fire-resistant layer 410A and the inner door panel 200 (i.e., such that the fire-resistant layer 410A is disposed between the structural layer 410C and the non-conductive layer 410B). As shown in FIG. 13B, in some instances, the structural layer 410C is disposed between the fire-resistant layer 410A and the non-conductive layer 410B (i.e., such that the fire-resistant layer 410A is disposed between the structural layer 410C and the inner door panel 200), or the structural layer 410C may comprise the non-conductive layer, as shown in FIG. 13D. In still other instances, as shown, for example, in FIG. 13C, the protective member 410 may be configured such that the fire-resistant layer 410A is disposed between the non-conductive layer 410B and the structural layer 410C (i.e., such that the non-conductive layer 410B is disposed between the fire-resistant layer 410A and the inner door panel 200, with the structural layer 410C disposed opposite the fire-resistant layer 410A from the non-conductive layer 410B).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwashing appliance, comprising:

a tub portion defining a forward access opening;

a door assembly configured to cooperate with the tub portion to cover the forward access opening, the door assembly comprising a tub-facing portion operably engaged with an outwardly-facing portion;

a control device mounted to the door assembly between the tub-facing portion and the outwardly facing portion thereof, the control device being adapted to selectively direct operation of at least one operational component of the dishwashing appliance; and a protective member configured to extend at least partially about the control device so as to be at least partially disposed between the control device and tub-facing portion of the door assembly, the protective member being comprised of a fire-resistant layer and a non-conductive layer, the fire-resistant layer being adapted to prevent a flame originating from the control device from interacting with the tub-facing portion of the door assembly, and the non-conductive layer being disposed between the fire-resistant layer and the control device and being adapted to prevent electrical contact between the fire-resistant layer and the control device.

2. A dishwashing appliance according to claim 1, wherein the tub-facing portion of the door assembly is comprised of a polymeric material.

3. A dishwashing appliance according to claim 1, wherein the fire-resistant layer is comprised of a metallic material.

4. A dishwashing appliance according to claim 1, wherein the non-conductive layer is comprised of a polymeric material.

5. A dishwashing appliance according to claim 1, wherein the protective member further comprises a structural element associated with at least one of the fire-resistant layer and the non-conductive layer, the structural element being configured to rigidify the protective member.

6. A dishwashing appliance according to claim 5, wherein the structural element comprises a structural layer disposed between the fire-resistant layer and the tub-facing portion of the door assembly.

7. A dishwashing appliance according to claim 5, wherein the structural element comprises a structural layer disposed between the fire-resistant layer and the non-conductive layer.

8. A dishwashing appliance according to claim 5, wherein the structural element is a structural layer comprising the non-conductive layer.

9. A dishwashing appliance according to claim 5, wherein the protective member is substantially planar and is comprised of a deformable material, and wherein the protective member defines at least one crease for facilitating deformation of the protective member to substantially conform to the structural element.

10. A dishwashing appliance according to claim 1, wherein the control device is mounted to the outwardly-facing portion of the door assembly and the protective member is configured to extend about the control device and to engage the outwardly-facing portion of the door assembly so as to substantially enclose the control device therebetween.

11. A dishwashing appliance according to claim 10, further comprising a sealing member extending between the protective member and the outwardly-facing portion of the door assembly so as to form a substantially sealed enclosure about the control device.

12. A dishwashing appliance according to claim 1, further comprising a detergent dispensing device operably engaged with the door assembly so as to be capable of interacting with dishwashing fluid circulated within an interior of the tub portion.

13. A dishwashing appliance according to claim 12, wherein the protective member is disposed between the detergent dispensing device and the control device to at least partially prevent contact between dishwashing fluid from the detergent dispensing device and the control device.

14. A dishwashing appliance according to claim 1, wherein the protective member is configured to wrap about the control device so as to be at least partially disposed between the control device and door assembly.

15. A dishwashing appliance according to claim 14, wherein the protective member is substantially planar and is comprised of a deformable material, the protective member further comprising a leading end and a trailing end, and being configured to be wrapped about the control device such that the leading end at least partially overlaps the trailing end.

16. A dishwashing appliance according to claim 15, further comprising a coupling device configured to couple the leading end to the trailing end to maintain the protective member about the control device.

17. A dishwashing appliance according to claim 14, wherein the protective member defines at least one crease for facilitating wrapping of the protective member about the control device.

18. A dishwashing appliance according to claim 1, wherein the protective member defines at least one aperture configured to at least one of receive a mounting device therethrough for mounting the protective member to the door assembly and receive wiring therethrough for electrical connection to the control device.

19. A dishwashing appliance according to claim 1, wherein the protective member is further comprised of a heat resistant material.

20. A dishwashing appliance according to claim 1, wherein the protective member is further comprised of at least one of a chemical resistant material and a chafe resistant material.

21. A protective arrangement for a dishwashing appliance having a tub portion defining a forward access opening, a door assembly configured to cooperate with the tub portion to cover the forward access opening, the door assembly comprising a tub-facing portion comprised of a polymeric material and being operably engaged with an outwardly-facing portion, and a control device mounted to the door assembly between the tub-facing portion and the outwardly facing portion thereof, the control device being adapted to selectively direct operation of at least one operational component of the dishwashing appliance, the protective arrangement comprising:

a protective member configured to extend at least partially about the control device so as to be at least partially disposed between the control device and tub-facing portion of the door assembly, the protective member being comprised of a fire-resistant layer and a non-conductive layer, the fire-resistant layer being adapted to prevent a flame originating from the control device from interacting with the tub-facing portion of the door assembly, and the non-conductive layer being disposed between the fire-resistant layer and the control device and being adapted to prevent electrical contact between the fire-resistant layer and the control device.

22. A protective arrangement according to claim 21, wherein the fire-resistant layer is comprised of a metallic material.

23. A protective arrangement according to claim 21, wherein the non-conductive layer is comprised of a polymeric material.

24. A protective arrangement according to claim 21, wherein the protective member further comprises a structural element associated with at least one of the fire-resistant layer and the non-conductive layer, the structural element being configured to rigidify the protective member.

25. A protective arrangement according to claim 24, wherein the structural element comprises a structural layer disposed between the fire-resistant layer and the tub-facing portion of the door assembly.

26. A protective arrangement according to claim 24, wherein the structural element comprises a structural layer disposed between the fire-resistant layer and the non-conductive layer.

27. A protective arrangement according to claim 24, wherein the structural element is a structural layer comprising the non-conductive layer.

28. A protective arrangement according to claim 24, wherein the protective member is substantially planar and is comprised of a deformable material, and wherein the protective member defines at least one crease for facilitating deformation of the protective member to substantially conform to the structural element.

29. A protective arrangement according to claim 21, wherein the control device is mounted to the outwardly-facing portion of the door assembly and the protective member is configured to extend about the control device and to engage the outwardly-facing portion of the door assembly so as to substantially enclose the control device therebetween.

30. A protective arrangement according to claim 29, further comprising a sealing member extending between the protective member and the outwardly-facing portion of the door assembly so as to form a substantially sealed enclosure about the control device.

31. A protective arrangement according to claim 21, wherein a detergent dispensing device is operably engaged with the door assembly so as to be capable of interacting with dishwashing fluid circulated within an interior of the tub portion, and wherein the protective member is disposed between the detergent dispensing device and the control device to at least partially prevent contact between dishwashing fluid from the detergent dispensing device and the control device.

32. A protective arrangement according to claim 21, wherein the protective member is configured to wrap about the control device so as to be at least partially disposed between the control device and door assembly.

33. A protective arrangement according to claim 32, wherein the protective member is substantially planar and is comprised of a deformable material, the protective member further comprising a leading end and a trailing end, and being configured to be wrapped about the control device such that the leading end at least partially overlaps the trailing end.

34. A protective arrangement according to claim 32, further comprising a coupling device configured to couple the leading end to the trailing end to maintain the protective member about the control device.

35. A protective arrangement according to claim 32, wherein the protective member defines at least one crease for facilitating wrapping of the protective member about the control device.

36. A protective arrangement according to claim 21, wherein the protective member defines at least one aperture configured to at least one of receive a mounting device therethrough for mounting the protective member to the door assembly and receive wiring therethrough for electrical connection to the control device.

37. A protective arrangement according to claim 21, wherein the protective member is further comprised of a heat resistant material.

38. A protective arrangement according to claim 21, wherein the protective member is further comprised of at least one of a chemical resistant material and a chafe resistant material.

* * * * *